United States Patent [19]

Peiler

[11] 4,443,236

[45] Apr. 17, 1984

[54] SELF-CLEANING SCREEN FOR THE COOLING AIR INLET OF AN ENGINE ENCLOSURE

[75] Inventor: Rolf Peiler, Zweibrucken, Fed. Rep. of Germany

[73] Assignee: Deere & Company, Moline, Ill.

[21] Appl. No.: 437,427

[22] Filed: Oct. 28, 1982

[30] Foreign Application Priority Data

Nov. 14, 1981 [EP] European Pat. Off. ..... 81 109690.8

[51] Int. Cl.[3] ..... B01D 35/02; B01D 35/18; B01D 46/04

[52] U.S. Cl. ..... 55/269; 55/294; 55/385 B; 55/431; 180/68.1; 180/68.6

[58] Field of Search ..... 55/293, 294, 298, 301, 55/303, 385 B, 431, 267–269; 180/54 A, 54 D, 68 P, 69 R, 68 R

[56] References Cited

U.S. PATENT DOCUMENTS

| | | | |
|---|---|---|---|
| 1,860,697 | 5/1932 | Traviss | 180/68 P |
| 2,601,704 | 7/1952 | Streun | 55/294 |
| 2,661,810 | 12/1953 | Heth | 55/301 |
| 2,942,690 | 6/1960 | Carpenter | 55/298 |
| 3,002,585 | 10/1961 | Pasturczak | 183/34 |
| 3,155,473 | 11/1964 | McNeil | 55/294 |
| 3,837,149 | 9/1974 | West et al. | 55/269 |
| 4,082,524 | 4/1978 | Noland | 55/294 |
| 4,233,040 | 11/1980 | Vogelaar et al. | 55/269 |
| 4,296,780 | 10/1981 | Norbäch | 55/294 |

FOREIGN PATENT DOCUMENTS 2418054 1/1976 Fed. Rep. of Germany .

*Primary Examiner*—David L. Lacey

[57] ABSTRACT

In a self-propelled combine, an engine cooling air screen is cleaned continuously by a rotating exhaust sweep moving close to its external surface. The sweep is in the form of a duct with one side open to the screen. Air is drawn into the sweep and exhausted through the cooling fan by way of an air passage having an inlet opening in the center of the screen communicating directly with the exhaust sweep and an outlet immediately ahead of the inlet side of the fan. Power for rotation of the sweep preferably comes from the propeller action of air passing over air deflector or propeller surfaces at its extremities. Alternatively, the sweep may be driven by a more conventional bladed propeller rigidly connected to the sweep but offset rotationally from it.

11 Claims, 5 Drawing Figures

SELF-CLEANING SCREEN FOR THE COOLING AIR INLET OF AN ENGINE ENCLOSURE

BACKGROUND OF THE INVENTION

This invention concerns an internal combustion engine cooling system and in particular means for filtering engine cooling air before it passes over a heat exchanger, such means being particularly useful on agricultural harvesting machines such as combines.

It has become conventional to at least partially enclose the engines of mobile harvesting machines and to mount a heat exchanger such as a radiator, for cooling the engine within the enclosure. It is also well-known to provide screens for filtering the cooling air drawn into the enclosure and also to provide means for removing from the screen accumulations of foreign materials such as chaff and leaves which occur in typical harvesting conditions.

Ideally, foreign material or trash removal should be automatic and continuous. Well-known attempts to achieve this include the use of rotating screens in conjunction with baffles or ducts adjacent the screen to upset the flow of cooling air through the screen so that foreign material has an opportunity to fall off or be drawn off. U.S. Pat. No. 3,837,149 West et al, also assigned to the assignee of the present invention, is an example of this general type of device. A fixed exhaust duct spans a portion of the exterior of a rotating screen so that air is drawn through the duct and locally reverses the flow of air through the screen so that foreign material accumulated on the screen is removed and carried through the duct. This type of self-cleaning filter arrangement is effective but does involve the complication of a drive to and sealing of the rotary screen. Typically, there is also the nuisance of the protuberance of the exhaust duct, beyond the periphery of the rotating screen.

U.S. Pat. No. 3,155,473 McNeil exemplifies another form of self-cleaning cooling air screen. Here the screen is stationary and a radially extending air duct rotates and sweeps the downstream or interior surface of the screen. The duct carries a propeller blade so that the flow of incoming air provides power to rotate the duct. An air passageway, with an inlet on the delivery side of the cooling fan, diverts some of the exhausting cooling air and feeds it to the "cleaning" duct so that, immediately in front of the duct, there is a reverse air flow, from the inside to the outside of the screen, tending to blow foreign material from the outside surface of the screen. This dislodged material is engaged by a sweeper vane which rotates with the duct to deflect the material away from the screen. This system obviously does not positively remove material away from the screen. Although the action of the sweeper vane may be to disperse some of the material radially outwards beyond the screen, there is the possibility of loss of control of the removed trash so that it may be again drawn onto the external surface of the screen. A further disadvantage of the McNeil system is the cost of providing the three separate components—propeller, duct, and sweeper vanes.

SUMMARY OF THE INVENTION

Accordingly, an object of the present is to provide a continuous cleaning means for the cooling air screen or filter of an internal combustion engine which avoids some of the costs, complexities and disadvantages of known devices of this sort.

According to the invention, an exhaust a sweep assembly having a sweep in the form of a duct having an inlet portion open to the exterior or upstream side of a cooling air screen sweeps at least a portion of the screen while the screen itself preferably, remains stationary. An exhaust air passage has an inlet communicating with an outlet portion of the exhaust sweep duct and an outlet at the upstream side of the cooling fan. Thus a portion of the incoming air is drawn through the exhaust sweep duct, creating a zone of reduced pressure between the duct and adjacent portions of the cooling air screen as the sweep moves over it. Foreign material held on the exterior side of the screen is lifted and entrained in the air flow and carried through the duct. Preferably, the motion of the sweep is rotary motion about a fixed axis approximately centered in the screen and power for this motion is derived from reaction between the incoming air and propeller means associated with the sweep. An auto rotation arrangement of this type has the advantage of simplicity and reliability but in keeping with the invention, other drive means for the sweep assembly, such as a conventional belt drive, may be provided if desired.

In a preferred embodiment of the invention, the exhaust sweep assembly rotates about an axis generally central and perpendicular to the cooling air screen and the exhaust air passage has an inlet concentric with this axis. The screen has a corresponding central aperture registering with the inlet of the air passage so that simple and direct movement of air (with foreign material entrained) from the exhaust sweep duct into the passage is effected. The foreign material is discharged downstream of the cooling air fan, remote from the cooling air screen, thus reducing the likelihood of the foreign material being "recirculated" and again coming into contact with the screen.

According to the invention, the exhaust sweep duct may be relatively shallow in cross section and, because of the central outlet, need not extend radially beyond the periphery of the screen. Thus according to the invention, the only essential moving part, namely the exhaust sweep, is conveniently and accessibly mounted, external to the screen and external protuberences are minimized.

DESCRIPTION OF THE PREFERRED EMBODIMENT

Figure 1:
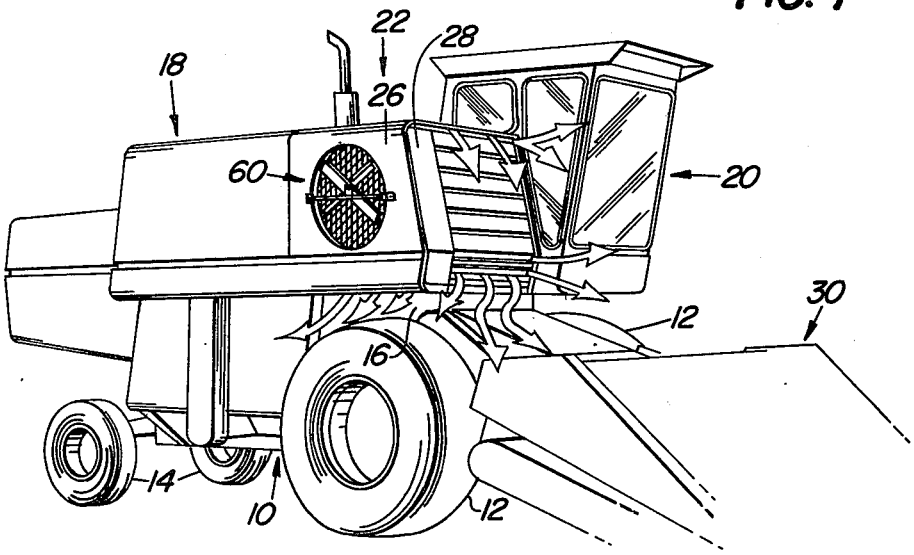
FIG. 1 is a right front perspective view of a combine including the improved engine enclosure and air filtering system.

The invention is embodied in a self-propelled combine having a main separator body or frame 10 mounted on a pair of forward drive wheels 12 and steerable rear wheels 14. The body has generally upright side walls 16 and an elevated grain tank 18 is mounted on a central portion of the body, the grain tank side walls being disposed outwardly of the body side walls 16. An elevated operator's station 20 is disposed at the left front of the body 10 immediately in front of the grain tank. A power unit enclosure indicated generally by the numeral 22 is disposed at the front of the body 10 immediately in front of the grain tank 18 and to the right of the operator's station 20. The enclosure 22 includes a generally horizontal top wall 24, a generally upright side wall assembly 26 in fore-and-aft alignment with the grain tank side wall and a front wall 28, the rear of the enclosure being formed by the front of the grain tank 18 while a control console (not shown) at the right side of the operator's station is interposed between the left end of the enclosure 22 and the operator's station 20. The terms left and right are used with reference to a person standing behind the machine and facing in the direction of its forward travel. The general construction of such a combine is described in greater detail in U.S. Pat. No. 3,636,684, Vogelaar et al, also assigned to the assignee of the present invention. Carried at the front of the combine is a harvesting header, such as the conventional corn head 30 here, (only a partial outline of which is shown) for removing crop from the field as the machine advances.

The description which follows relates mainly to the enclosure 22 and the components which it houses and particularly to an improved means for filtering engine cooling air being drawn through the enclosure. This embodiment of the present invention includes many details of structure and function similar to those described in detail in U.S. Pat. No. 3,837,149 West et al, entitled "Engine Enclosure and Cooling System with Rotary Filter" and also assigned to the assignee of the present invention and hereby incorporated by reference.

Figure 3:
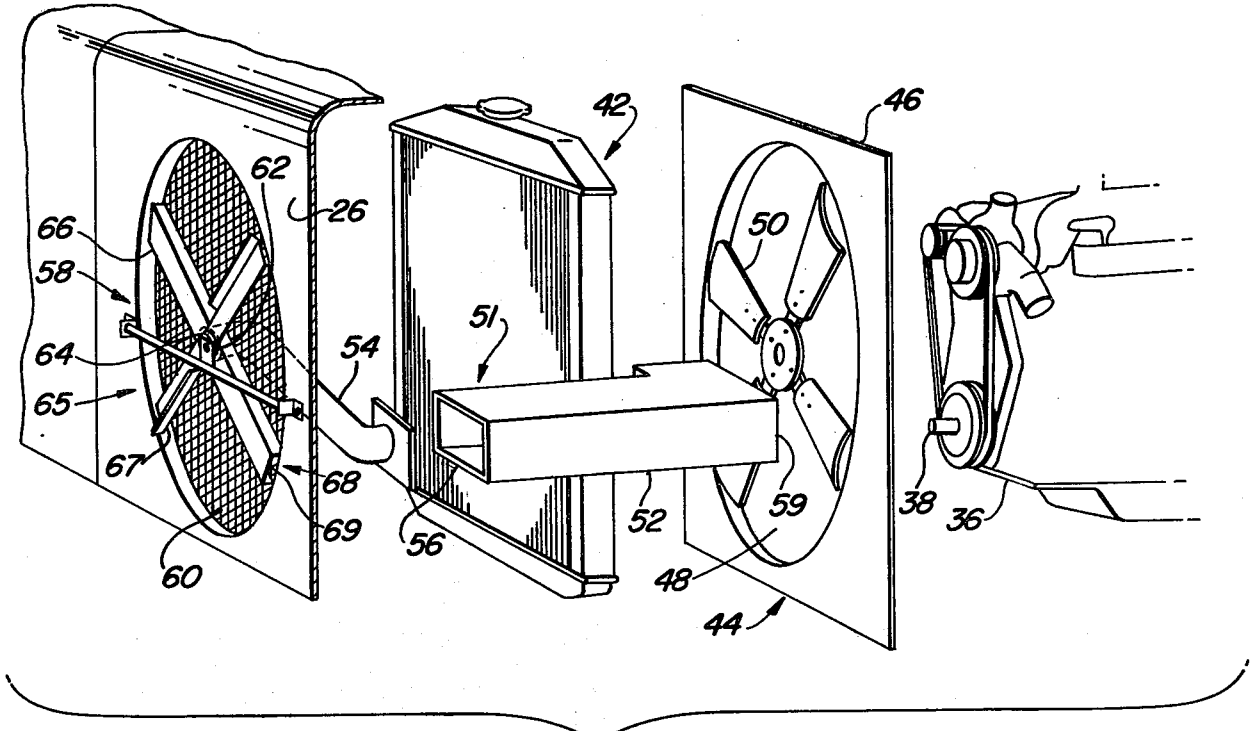
FIG. 3 is an exploded somewhat schematic perspective view of the engine and of the principle components of the engine cooling system external to the engine.

A transversely oriented internal combustion engine 36 (shown partially only in FIG. 3) is mounted in the enclosure 22 and has an accessory drive shaft 38 extending from the right-hand end of the engine. A heat exchanger, such as the conventional radiator 42 shown here, upright and fore-and-aft extending, is mounted at the right end of the enclosure between the right side wall 26 and the engine 36 and includes conventional hoses (not shown) for conducting coolant to and from the engine. A blower assembly 44 including a fan shroud 46 is mounted between the engine 36 and the radiator 42. The shroud 46 has a large circular opening 48 opposite the radiator core. A pull-type blower or fan 50 is coaxially mounted in the fan shroud opening 48 and is driven conventionally by the engine.

Also within the enclosure 22 is an exhaust passage assembly 51 consisting of an exhaust duct portion 52 and an exhaust pipe portion 54. These are detachably connected at a coupling 56 and together make an air passage which extends from an inlet 58 in the exhaust pipe 54 adjacent the right-hand outer wall 26 of the enclosure 22, past the forward side of the radiator 42 to an outlet 59 adjacent the fan wheel 50 on its inlet or upstream side. A cooling air screen or filter 60 is set into the righthand side wall 26 of the engine enclosure and has a central opening 61 registering with the exhaust pipe inlet 58. The design of the enclosure ensures that substantially all air drawn into the enclosure by the fan 50 passes first through the screen 60. The major portion of the air then passes through the radiator 42 while a lesser portion is drawn off through the air passage assembly 51, bypassing the radiator 42 before being exhausted by the fan wheel 50.

A support arm assembly 62 extends approximately horizontally and externally across the face of the screen 60 and provides support for a stub shaft 64 extending perpendicular to and towards the screen 60. Journalled on the stub shaft 64 is an exhaust sweep assembly 65 comprising an exhaust sweep 66 and, rigidly attached to it, a propeller 67. An open mesh guard (not shown) may be mounted over the rotating sweep and propeller 67.

Figure 2:
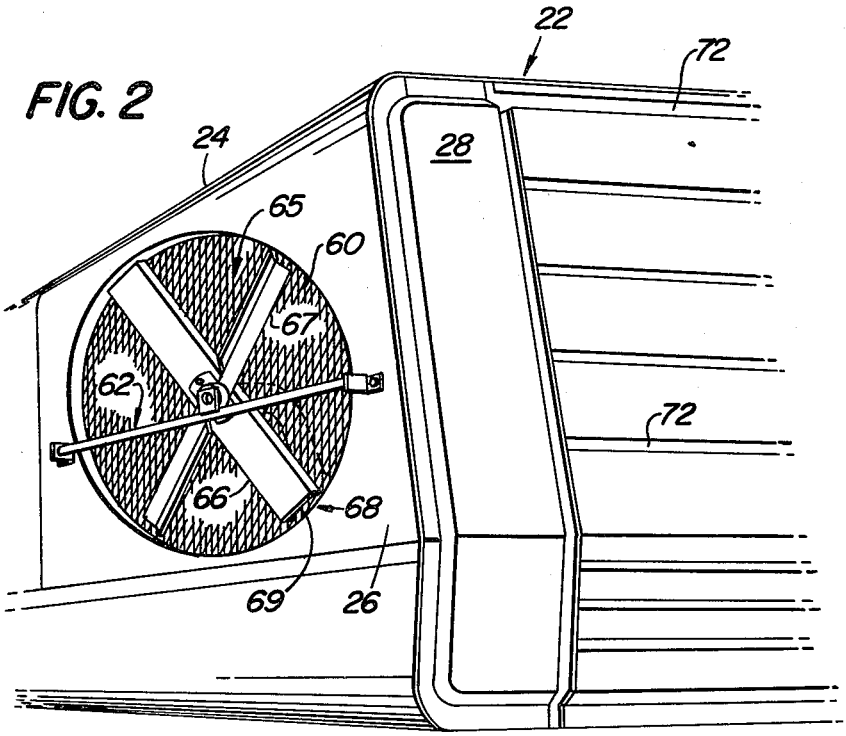
FIG. 2 is an enlarged right front perspective view of a portion of the engine enclosure including an external view of the cooling air cleaning device.
Figure 4:
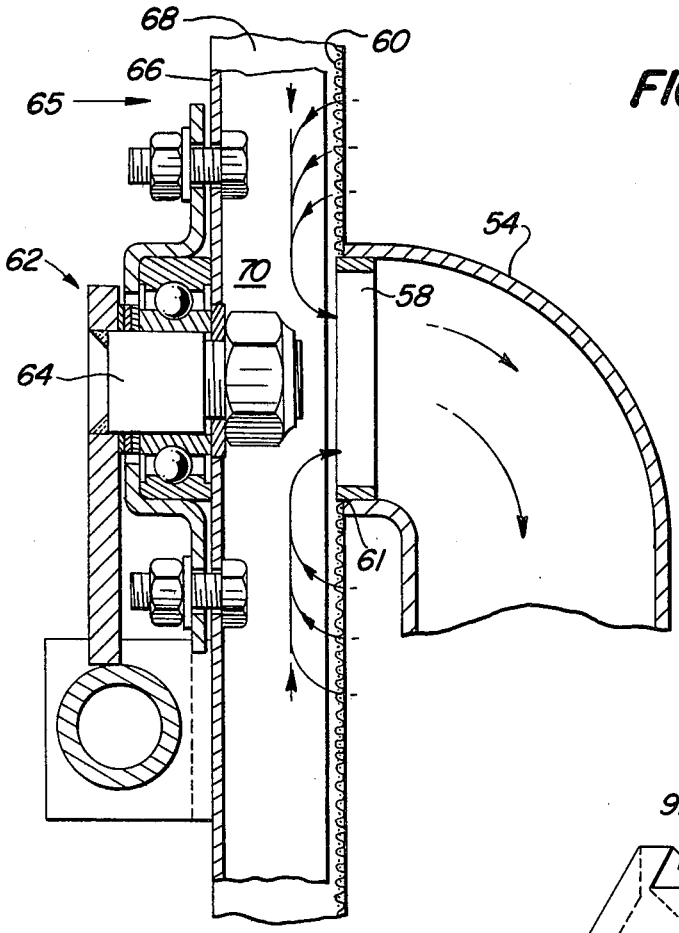
FIG. 4 is an enlarged cross-sectional view showing details of the exhaust sweep assembly mounting and inlet to the exhaust pipe.

The exhaust or collecting sweep 66 is of channel cross section open at both ends (69), mounted to sweep closely over the exterior surface of the screen 60 so that the space between the walls of the exhaust sweep 66 and the screen 60 in effect constitutes a moving or revolving collecting and exhaust duct or conduit 68. As can be seen especially in FIG. 2, the exhaust sweep 66 spans a major portion of the screen 60. Its axis of rotation is coaxial with the inlet 58 of the exhaust pipe 54 so that exhaust air may pass freely from an outlet portion 70 of the duct 68 into the exhaust pipe 54, as seen best in FIG. 4. The exhaust duct 68 is, in this embodiment, of uniform cross section, but the outlet portion 70 becomes defined by its juxtaposition with the inlet 58 of exhaust pipe 54 and the resulting air flow pattern (indicated in FIG. 4).

Figure 5:
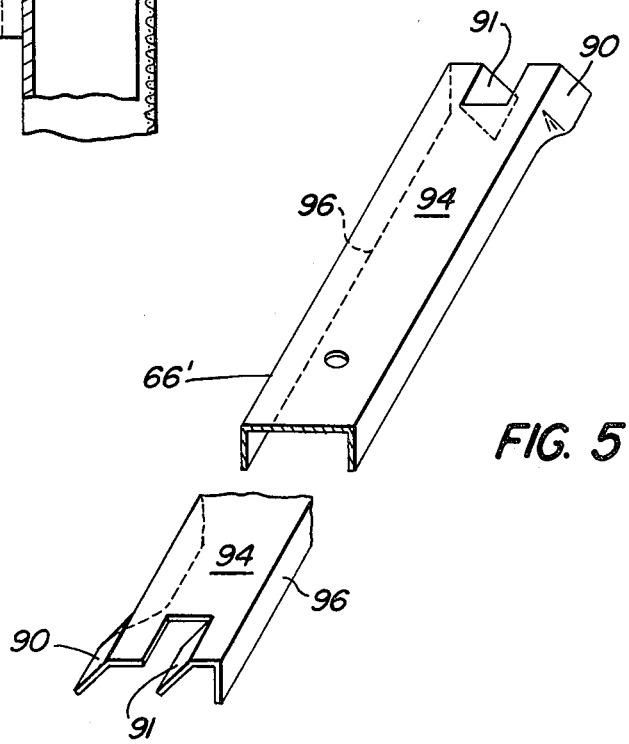
FIG. 5 is an enlarged removed perspective view of an exhaust sweep including air deflecting (propeller) surfaces.

FIG. 5 shows an alternative exhaust sweep 66' in which the ends of the channel form have been modified to provide air deflecting or propeller surfaces so that the sweep itself becomes auto rotating and requires no separate propeller (67). The basic form of the exhaust sweep 66' is still an inverted channel with floor 94 and opposite side walls 96. In its simplest form, the exhaust sweep 66' is modified to provide a pair of opposite deflecting surfaces by bending outwards, against the direction of intended rotation, diagonally opposite end portions 90 of the side walls 96. Additional propelling force may be obtained by notching and bending downwards additional propelling surfaces, louver-like tabs 91 in the opposite ends of the sweep.

In operation, cooling air is drawn through the screen 60 and over the radiator 42 as is conventional. At the same time, "cleaning" air is drawn through the exhaust sweep 66 and the exhaust passage assembly 51 by the fan 50 and exhausted into the engine enclosure 22 and thence, at least in part, to the atmosphere through openings 72 in the enclsoure. The action of the fan wheel immediately adjacent the outlet 59 of the duct portion 52 is to reduce pressure in the exhaust line including the duct portion 68 so that air may flow into the duct 68 backwards or outwards through the screen 60 as well as radially inwards through the open ends 69 of the exhaust sweep 66. Thus, as the sweep rotates and sweeps the screen 60, propelled by the flow of cooling air over propeller 67 (or propeller surfaces 90, 91 in the embodiment of FIG. 5), the flow of air in the duct portion 68 may continually lift trash particles from the surface of the screen 60 and entrain them in the air flow and carry them through the inlet 58 of the exhaust pipe 54 to be ultimately discharged from the engine enclosure 22 by way of openings such as the openings 72 indicated in FIG. 2.

The embodiment of the invention described above is clearly very simple. When a self-powered sweep 66' as shown in FIG. 5 is used, screen cleaning is effected by only one simple moving part, the sweep 66' itself. The cost and complication of parts to drive the sweep and/or a rotating screen are eliminated. An additional advantage, compared with the rotating screen devices, is the elimination of the need for sealing against trash entry at the junction between moving screen surfaces and fixed portions of the enclosure.

As indicated here, a simple, shallow channel form for the rotating exhaust sweep 66 is adequate. A constant cross section form has been shown but there are potential cost savings and efficiency increases in modifying the form of the sweep by varying its cross section. For example, a tapered form in which the sweep dimensions are greater closer to the axis of rotation where air flow through the duct portion 68 is greatest may be used.

The invention has been described in an internal combustion engine cooling air application but clearly it has other applications where a flow of air must be cleaned of relatively large particles of foreign material before use.

I claim:

1. In an agricultural machine having a mobile body and a power unit carried by the body, the power unit including a wall having an air inlet, an internal combustion engine, a heat exchanger for cooling the engine and a blower operable to draw cooling air through the inlet and over the heat exchanger, an improved air cleaning apparatus for the cooling air comprising:

an air filter supported adjacent the wall and including a filter element having a foraminous portion and exterior and interior sides covering the inlet for filtering and holding on its exterior side, foreign material from the cooling air moving through the inlet;

an exhaust passage having an outlet communicating with the upstream side of the blower and an inlet adjacent the interior side of the filter element so that the blower may draw air through the passage from the inlet to the outlet;

an exhaust sweep assembly including an elongated sweep defining a collecting duct adjacent the exterior side of the filter element, said duct having an air inlet portion including a first inlet adjacent and open to and spanning a portion of the exterior side of the filter element and an outlet portion axially adjacent the inlet portion and including an outlet, said sweep assembly being mounted for sweeping motion relative to the filter element so that the first air inlet sweeps at least a portion of the exterior side of the filter element, and said duct outlet communicating with the exhaust passage inlet so that the blower draws air into and through the duct via the duct inlet, some air being drawn directly from the atmosphere externally adjacent the filter element and some of the drawn air being diverted from the interior side of the filter element and drawn outwards through the filter element, and being drawn through the duct inlet entraining foreign material held on the exterior side of the filter element and carrying it through the duct to the duct outlet and into the exhaust passage;

means for mounting the sweep assembly adjacent said filter element; and means for imparting a sweeping motion to the sweep assembly.

2. The agricultural machine of claim 1 wherein the air filter element includes an opening registering with the duct outlet so that removed foreign material passes through the filter element opening.

3. The agricultural machine of claim 2 wherein the mounting means includes means for journaling the sweep assembly for rotation about a fixed axis, the disposition of said axis with respect to the exterior side of the filter element being such that, on rotation, the sweep assembly sweeps the filter element with a circular motion and the spacing of the duct from the filter element remains approximately constant and the duct outlet is adjacent said axis of rotation.

4. The agricultural machine of claim 3 wherein the means for imparting a sweeping motion includes air deflecting means upstream of and adjacent the filter element such that the flow of cooling air over said deflecting means imparts a circumferential force to the sweep assembly so as to produce said circular motion.

5. The agricultural machine of claim 4 wherein the air deflecting means comprises a propeller blade drivably connected to the sweep.

6. The agricultural machine of claim 5 wherein the sweep includes at least one radially extending portion and the propeller blade is rotationally offset from that portion.

7. The agricultural machine of claim 4 wherein the air deflecting means includes a louver-like tab integral with the sweep and radially remote from the axis of rotation.

8. The agricultural machine of claim 3 wherein the collecting duct inlet portion includes a substantially radially outwardly directed second inlet opening radially remote from the axis of rotation.

9. The agricultural machine of claim 3 wherein, with respect to the flow of cooling air, the sweep has a downstream side adjacent the exterior side of the filter element and an opposite upstream side and the axis of rotation of the sweep assembly is defined by rotational bearing means supported by the mounting means and engaging the sweep assembly externally of the upstream side of the sweep.

10. The agricultural machine of claim 3 wherein the sweep is in the form of an inverted channel extending generally radially from and spanning the axis of rotation, said channel defining the cut and comprising a floor approximately parallel with and spaced from the exterior side of the filter element and opposite walls having free edges adjacent said exterior side, said walls at least partially defining between them the first inlet of the duct.

11. The agricultural machine of claim 10 wherein the sweep extends equally in two diametrically opposite directions with respect to the axis of rotation.

* * * * *

UNITED STATES PATENT AND TRADEMARK OFFICE

CERTIFICATE OF CORRECTION

PATENT NO. : 4,443,236

DATED : 17 April 1984

INVENTOR(S) : Rolf Peiler

It is certified that error appears in the above-identified patent and that said Letters Patent is hereby corrected as shown below:

Column 6, line 51, delete "cut" and insert -- duct --.

Signed and Sealed this

*Eighth* Day of *January 1985*

[SEAL]

*Attest:*

*Attesting Officer*

GERALD J. MOSSINGHOFF

*Commissioner of Patents and Trademarks*